US007827724B1

(12) United States Patent
Spinelli

(10) Patent No.: US 7,827,724 B1
(45) Date of Patent: Nov. 9, 2010

(54) NO-DRILL REAR SIGHT SCOPE MOUNT BASE

(76) Inventor: Michael Angelo Spinelli, 293 W. Essex Ave., Lansdowne, PA (US) 19050

( * ) Notice: Subject to any disclaimer, the term of this patent is extended or adjusted under 35 U.S.C. 154(b) by 687 days.

(21) Appl. No.: 11/796,974

(22) Filed: Apr. 30, 2007

Related U.S. Application Data

(63) Continuation-in-part of application No. 11/429,847, filed on May 8, 2006, now abandoned.

(51) Int. Cl.
*F41G 1/40* (2006.01)

(52) U.S. Cl. ..... 42/124; 42/125; 42/126; 42/127; 42/128; 248/295.11; 248/298.1; 248/296.1

(58) Field of Classification Search ..... 42/124–128
See application file for complete search history.

(56) References Cited

U.S. PATENT DOCUMENTS 3,922,794 A * 12/1975 Ackerman, Jr. ..... 42/126
4,291,476 A * 9/1981 Repa ..... 42/124
4,742,636 A * 5/1988 Swan ..... 42/126
5,086,566 A * 2/1992 Klumpp ..... 42/126
5,941,489 A * 8/1999 Fanelli et al. ..... 248/298.1
6,442,883 B1 * 9/2002 Waterman et al. ..... 42/124
6,722,074 B1 * 4/2004 Farrell ..... 42/124
7,204,052 B2 * 4/2007 Swan ..... 42/127
7,240,451 B2 * 7/2007 Blair ..... 42/124
7,334,365 B2 * 2/2008 Kim ..... 42/124
7,444,776 B2 * 11/2008 Adams ..... 42/127
7,543,405 B1 * 6/2009 Ivey ..... 42/125
2006/0010758 A1 * 1/2006 Zeh ..... 42/124

* cited by examiner

*Primary Examiner*—Troy Chambers
*Assistant Examiner*—Samir Abdosh
(74) *Attorney, Agent, or Firm*—Lipton, Weinberger & Husick; Robert J. Yarbrough

(57) ABSTRACT

A scope mount base design which readily accepts onto a preexisting rear sight base without any alteration of the sight base except for the easy removal of the original sight leaf and mainspring. This scope mount invention achieves solid lockup by the use of the appropriate sized threaded support fixtures and scope mount configuration to successfully engage these rear sight slots that originally contained the sight leaf and mainspring, and thus achieve strong lockup of the scope mount to the sight base.

11 Claims, 11 Drawing Sheets

NO-DRILL REAR SIGHT SCOPE MOUNT BASE

I. RELATED APPLICATION

This application is a continuation in part of application Ser. No. 11/429,874, filed on May 8, 2006, now abandoned and titled "NO DRILL REAR SIGHT SCOPE MOUNT BASE", by Michael Angelo Spinelli, inventor. The provisions of that application are incorporated by reference as if set out in full herein.

II. BACKGROUND OF THE INVENTION

A. Field of the Invention

The Invention relates to a telescopic sight mount for a rifle, specifically a telescopic sight mount for a '98 Mauser rifle.

B. Description of the Related Art

Many rifle designs especially those of military nature were built with quite robust rear sight designs, most famous of these being the K98 Mauser. Over the years many other rifle designs have emulated those of the Mauser. My invention is concerned with the manner in which the K98 Mauser long tangent rear sight base assembly was configured, in particular the top portion of the rear sight base. This base design allowed for the easy removal of the sight blade (55) at the anterior base section and the leaf spring from the posterior of the base. This easy removal was achieved by the machining of upward, inward facing opposing bosses at the anterior of the base. The upward bosses also contained a through hole, in which the bisected upper portion of that hole was centrally located at the thicker lower edge of the inward facing bosses.

There were outward facing, round lateral extensions located at the front of the tangent sight blade. These lateral extensions were then captured by the inward facing anterior base bosses at the upper circumference of the boss through hole on the thicker lower edge of the boss of the anterior of the base. The rounded lateral outward extensions of the sight blade front, captured by the mating upper boss hole circumference, enabled the sight blade to then pivot upwards from the posterior of the sight base and gain elevation if necessary for a longer shot. A movable slider on the sight blade kept the elevation adjustment in place on the sight base.

The leaf mainspring, which extended longitudinally from the posterior of the sight base U shaped spring slot, applied upward pressure against the front outward facing round protrusions of the sight blade. This upward pressure by the mainspring, against the bottom front of the sight blade and ultimately to the upper circumference hole of the inward facing opposing bosses, kept the sight blade in place at the anterior of sight base.

The presence of these base bosses, boss through hole, and U shaped slot at the posterior sight base makes my scope mount invention possible.

The long tangent rear sight did not first appear on Mauser military rifles until after 1900. It soon became the main rear sight. Most new, and Mauser rifles returning to the arsenals for refurbishing were retrofitted with the long tangent rear sight after that date. Total production of Mauser military rifles from 1888 to 1945 is estimated at over 100,000,000. My estimate is that over seventy five percent utilize the long tangent rear sight.

The need for a scope mount to readily replace the rear sight assembly is evidenced by the prices these said guns are fetching in their original condition. A reliable scope mount that can readily be attached to the rifle without in anyway detracting from its original appearance except for the easy removal and later replacement of these said original parts, the sight blade and main spring, should be marketable.

The forward location of the rear sight will require a long eye-relief scope in actual use. These scopes are common and very useful as they do not block the back receiver area of the rifle where bolt manipulation and ammunition loading take place.

As for other related patents that use a preexisting forward sight base in their application, I could only find one, the George McCann (U.S. Pat. No. 2,036,290) scope mount. His patent also utilizes preexisting holes and notches to fasten the mount to the rifle. His 1936 patent utilizes the rear sight base of a 1903 Springfield rifle (Actually a 1898 Mauser in basic design) and the magazine hold catch slot on the receiver as basic points of affixing the rifle. My design is an improvement over the McCann in that his use of the rear sight base slots only fixes at one point in the sight base which provides an unequal purchase of the slots. His capture forces are all in the up direction with a single lever screw turned from the top mounting plate exerting upward pressure of this mounting plate towards the sight base undercuts. The use of upward pressure alone to secure an item will work in the short run but for long term usage a downward force on the mount to the sight is preferable. The McCann design also only fastens at 2 points and there is a fairly long distance between those fastening points, approx. ten inches. Such a long span between fasteners probably caused scope flexing on recoil. My design is far shorter, approx. three inches, and fastened and locked in at three points all within the space of the host rear sight base and all exerting downward force of my scope mount base to the sight base.

I am aware of two other designs (actually only one as they both work on the same principal) that utilize the rear sight base of the K98 as the mounting point for their scope mounts. These products are marketed by Mitchell's Mausers, and the other by B-Square. They both utilize previously stated inward area of the opposing sight base bosses, as the forward fixing point of their scope mounts to the rear sight base, however they do not have the outward facing slots as my invention has on the front scope mount body sides to capture the lower edges of the sight base bosses. Their rear sight bosses only make contact with the said sides of the body at their vertical inward edge. No contact is made with the bosses' lower edge As for lockup at the posterior of the sight base the competition rely on a blind top body tension screw to put upward bearing, reverse pressure upon the back of their scope mount. The screw is not fixed into anything on the sight base. The screw is just exerting pressure on the sight base surface at the relatively small surface area of the screw tip contact.

My lockup at the posterior of the sight base utilizes a threaded T nut which is sized so as to fit in the U shaped slot of the posterior of the sight base. A screw head tension screw then captures the back of my scope mount in a top body counter bored through hole. The screw is fixed into a threaded T nut being held by the U slot of the sight base. Upon tensioning, the scope mount body back is drawn down tightly against the top posterior area of the sight base. In addition the bottom of my scope mount body also contains a slot sized to capture the top edges of the T nut. Upon tensioning, the top area of the T nut is firmly engaged in this bottom slot of my scope mount body. The back lateral forces that occur upon recoil are restricted now by the much broader surface area of the T nut and not just the relatively narrow area of the point contact of a tensioning screw. Recoil forces from a rifle cartridge generate approximately fifty thousand foot pounds per square inch force. This force extends mostly in a longitudinal and lateral direction in relationship to the bore. In order for these forces to be properly contained and absorbed a broader surfaced capture system is needed than a simple blind reverse pressure screw as featured on the competition's offerings.

The other Mauser 98 tangent rear sight scope mount that I am aware of is the ZF41. The scope mounting system was developed by Germany during WWII. From my inspection of one of these scope mounting systems mounted on a Mauser 98 rifle, I feel that there is no crossover whatsoever. The system replaces the removable second part that appears on some of the rear sight bases. The area that is removed is then replaced with a new part designed to fit in removed area. The mainspring and sight blade are then returned to the rifle on the new part and function as previously stated. The ZF41 telescope mounting solution is then arrived at from side appendages on the redesigned replacement new part. Since the anterior rear sight bosses and a T nut at the posterior of the sight base are not involved in the ZF41, I see no problem with the claims of my design.

III. SUMMARY OF THE INVENTION

The present invention is easy to manufacture. It consists of few components, all of which are fairly easy to machine. This keeps costs down and makes the invention affordable.

The scope mount body has a top body configuration to accept popular telescopic sight designs.

The scope mount body accepts long eye relief scopes, which are an advantage in hunting as there is no scope ocular close to your eye blocking the line of sight, thus providing excellent field of view when acquiring the target.

The receiver end of the rifle is also left uncluttered by this scope mount body design, leaving this area open for easy access to the operating bolt and ammunition magazine.

No permanent modifications need be done to the host sight or rifle that will in any way affect the historical importance or collector's value of the rifle.

The scope mount body has front, side, outward facing boss slots that engage the anterior inward facing bosses present in the host rear sight in such a manner so that when side pressure is exerted by two boss screws into the body, a down and side locking force is applied to the scope mount body.

A further down force is applied at the back of the sight base by a vertical tension screw captured by the scope mount body and fixed into the threaded T nut which is held captive at the T nut wings by an equal bearing U shaped slot at the back of the sight base.

Multiple T nuts are supplied with the scope body in order to achieve almost universal success when applying my scope mount to the variations within the 98 Mauser rear sight assemblies.

There is a means of leveling the body to the bore axis by a spacer that is installed in the bottom body slot, by a tension screw, though an unused top body through hole that is provided.

A top body mounted compression screw threaded hole is provided so that a headless compression screw may be utilized against the forward top edge of the releasable second part of a two part base. This is to prevent minor upward recoil forces from jarring the front of the releasable second part up from the first part of two piece sight base variants.

Prototypes of this invention have shown the design and applications to be quite sound and without failure for over six hundred test firings without any lose of accuracy.

IV. BRIEF DESCRIPTION OF THE DRAWINGS

FIG. 1A Mauser 98 rifle fore end with standard tangent rear sight. (prior art}

FIG. 1B Mauser 98 rifle fore end with telescopic scope and my scope mount attached, FIG. 2 is a complete view of a Mauser 98 long tangent rear sight. (prior art)

V. DETAILED DESCRIPTION OF THE INVENTION

Figure 1A:
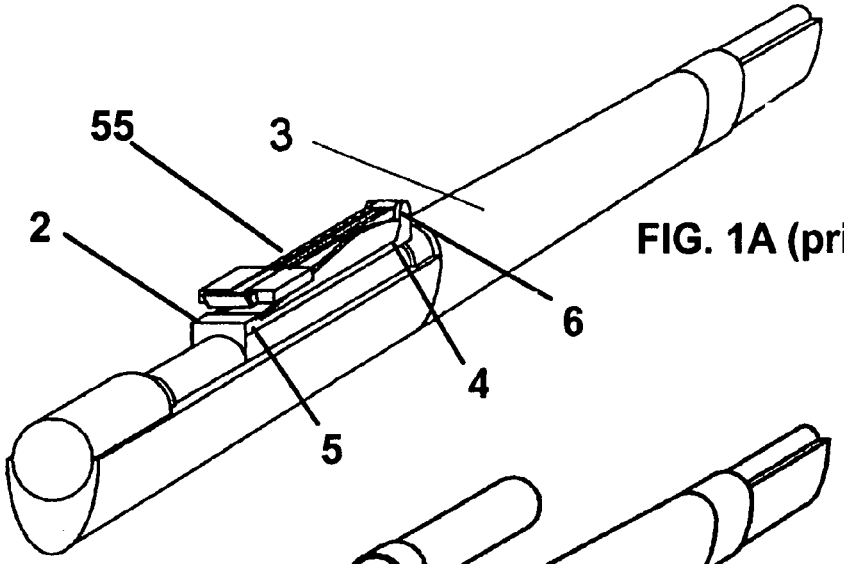
FIG. 1A (prior art)
Figure 1B:
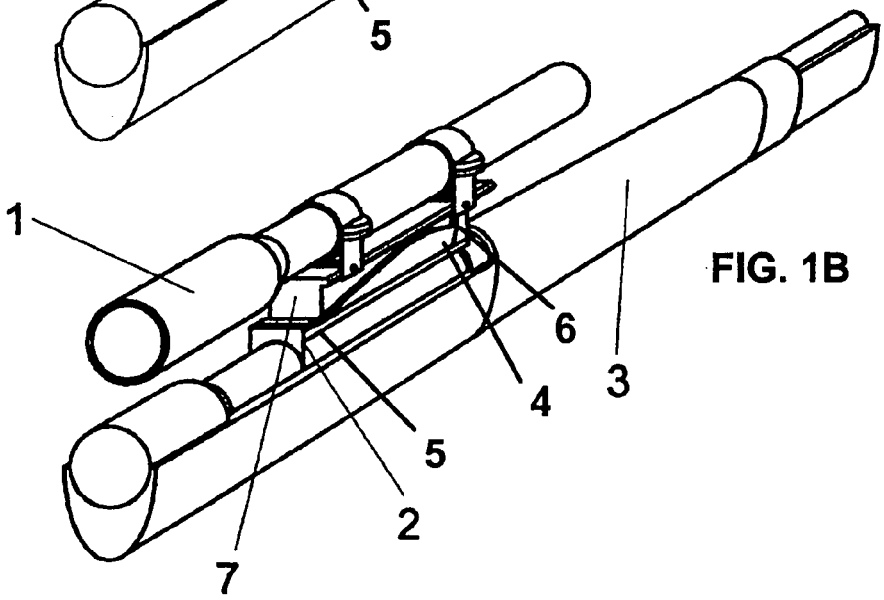
Figure 2:
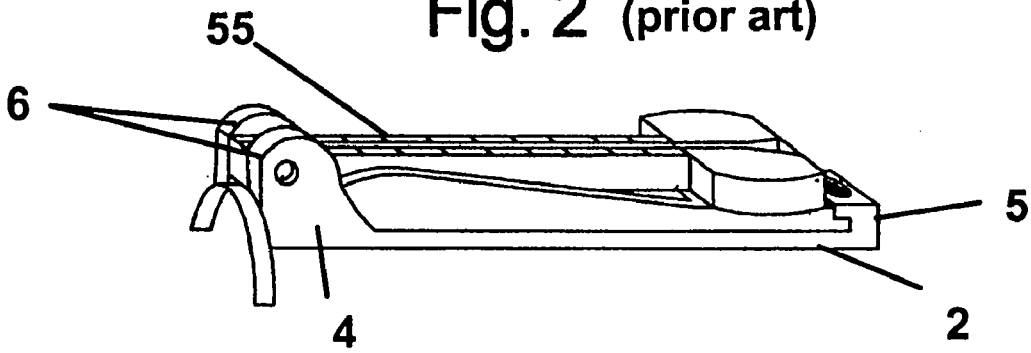
Fig. 2 (prior art)
Figure 3:
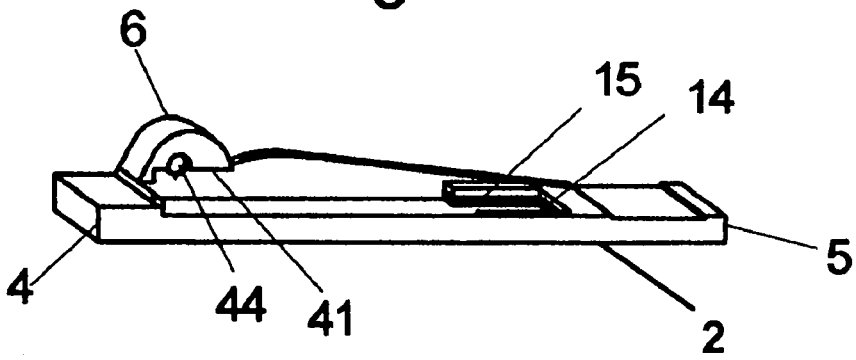
Fig. 3 (prior art)
FIG. 3 is a left side cutaway of a one piece rear sight base, forward spring slot (prior art)
Figure 4:
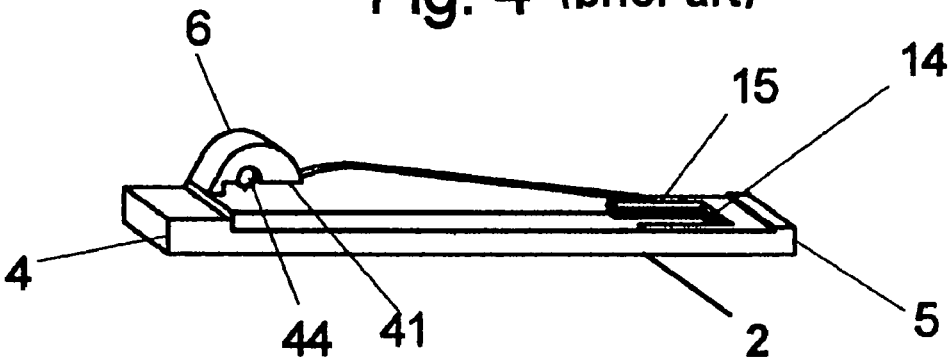
Fig. 4 (prior art)
FIG. 4 is a left side cutaway of a one piece rear sight base, posterior spring slot. (prior art)

The success of my rear sight long eye relief scope mount is dependent on the preexistence of certain specific features in the host Mauser 98 (FIG. 1) long tangent rear sight base (FIG. 2);

A—In the anterior portion (4), a pair of inwardly projecting, opposing, bosses (6) that project upwards on the sight base. There is also a boss through hole (44) in each of these said bosses (6). These through holes are positioned so that their upper circumference and horizontal diameter passes through the bosses' (6) lower side edge (42).

B—In the posterior (5) of the sight base, a pair of opposing spring slots (15) is located longitudinally to the bore (36) in the sight base posterior.

The scope mount body (7) consists of top (10), bottom (11), side (12), front (8), and back (9). On the top of the body, you have the general configuration to accept the telescopic sight (54). The top back (10) also has three vertical screw holes. These three holes are central to the lateral bore axis. The top screw hole nearest the front is threaded (35). The remaining two holes are countersunk through bored (25). The bottom (11) of the body has a centrally located slot (26) that begins just after midpoint and continues out the back (9). The front part of the bottom is cutaway so the body may fit forward in the sight base anterior, ahead of the sight base upward projections (6). Each body side contains a boss slot (13) in the front (8). Also a boss slot lateral threaded hole (46) is presented within the boss slot area between each boss slot.

At the anterior (4) of sight base, a capture area (47) for the scope mount is formed by the projecting opposing bosses (6). The tower side edges of the sight base bosses (41) mate to the boss slots' (13) lower edges (42) of the lower front portion of the scope mount body (7). The boss slot area (13) of the body also contains a lateral threaded through hole (46). This though hole (46) is positioned so that its lower horizontal diameter is located at the boss slot lower edge (42). The lower boss edge (41) is located at the upper horizontal diameter of the boss through hole (46).

Front lockup (8) of the scope mount body to the sight base anterior (4), (6) upward projections is achieved by passing the lower front area of the body into the capture area (47) formed by the area of the opposing bosses (6), and securing with two boss bolts (45), one through each opposing boss bolt hole (44), and into the threaded boss slot threaded lateral through hole (46).

Posterior lockup of the scope mount to the sight base is achieved by utilizing a specially heat treated and spring tempered T nut (16), whose wing (21) fits within the posterior opposing spring slots (15) of the sight base posterior (5). A centrally located threaded T nut hole (22) accepts a screw head tension screw (24), (25), which vertically passes through the top body (10) counter bored, through bored clearance hole (25) in the back (9) of the body and secures the scope mount back (9) to the posterior (5) of the sight base. Once the top surface areas of the T nut wing (21) are drawn up against the lower spring slot edges (15) of the sight base, a strong down lock of the scope mount body to the sight base occurs.

Also contained in the bottom back of the scope mount body is a T nut engaging slot (26) which closely mates with the top portion of the T nut (16). When tension is applied from the vertical screw head tension screw (23), (24) into the T nut (16), the close mating of the T nut engaging slot (26) to the T nut, effectively eliminate any lateral forces to the bore (36) resulting from rifle recoil. These lateral forces could possibly affect the stability of the back lockup.

Figure 14:
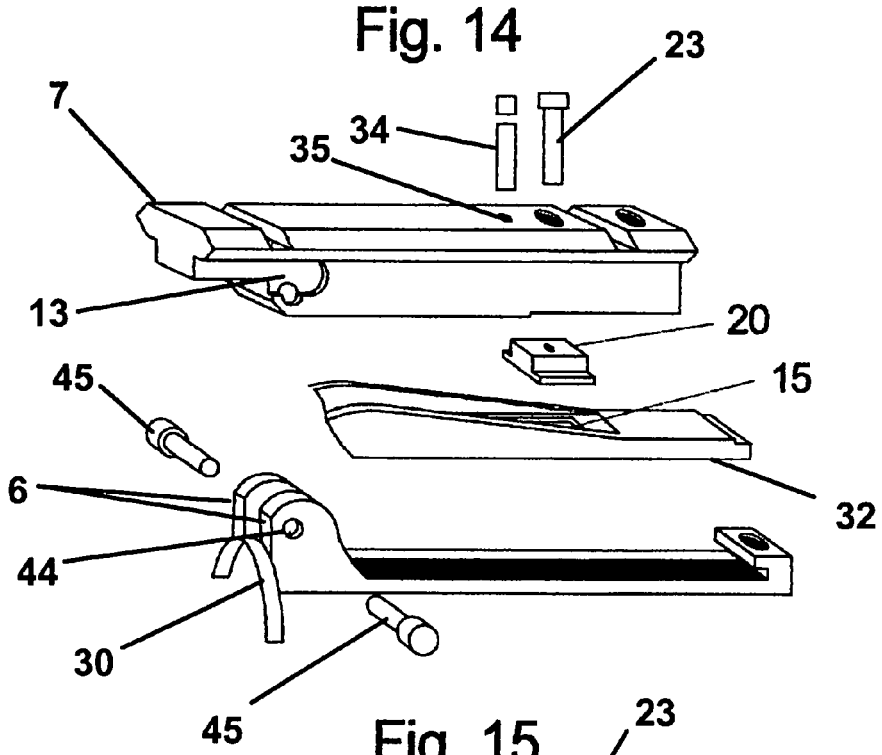
FIG. 14 is a perspective view of the two piece sight base (with forward spring slots) onto the scope mount body, including compression screw, and T nut.

The position of the opposing longitudinal sight base spring slots (15) on the posterior of the sight base (5) is subject to variance. This variance in the position of the spring slots necessitates a second vertical tension screw clearance hole (25) in the back of the scope mount. A plurality of T nuts (16) of varying heights and thickness can than accommodate most back body lockup situations to the sight base posterior. Through examination of various Mauser long tangent sight bases (FIGS. 3,4,5,6), I have determined that four T nuts are needed to make the scope mount universal in application. Two of the T nuts have different thicknesses in their wings (17), (18) to accommodate the variance of thickness in examined sight base spring slots (15). One of the T nuts has an offset centered threaded hole (19) to accommodate the possible mounting situation where the wings of the T nut, can only engage the sight base spring slots (15), and be in proper alignment to receive the vertical tension screw head screw (23,24) of the scope mount top body through hole (25). The last T nut needed has a significantly lower height (20) to accommodate a specific variance in the sight base spring slot encountered (FIG. 14).

Another variance in the sight base posterior (5) that became apparent as more sight base variations were tested, was the angle of the scope mount body to the bore of the rifle (39) was often not parallel. Absolute parallels are not a needed as the telescopic scope (1) has its own vertical and horizontal adjustments. It is of a good design though that the scope mount body should come up relatively parallel to the bore. The solution is to utilize the unused vertical clearance hole (25) of the scope mount body and have a screw head tension screw fix (23),(24) an unused T nut of correct thickness into the bottom engaging slot. If an unused T nut is incorrect for the application, then a supplied threaded spacer (37) is utilized. Thus firmly fixed to the body in the bottom body slot (26), the spacer or unused T nut now provides a broad contact surface area to the top of the rear sight posterior and also brings the body (7) to a good level. When tension is applied by the other body tension screw (23), (24) into the proper T nut (16) held in the spring slots (15) of the sight base, besides the previously stated lockup features, the body will now also be relatively parallel to the bore (39).

Another issue that my scope mount had to deal with in making the scope mount universal to the long tangent sight base (2), was the issue of the two part sight base (21) variance.

Figure 5:
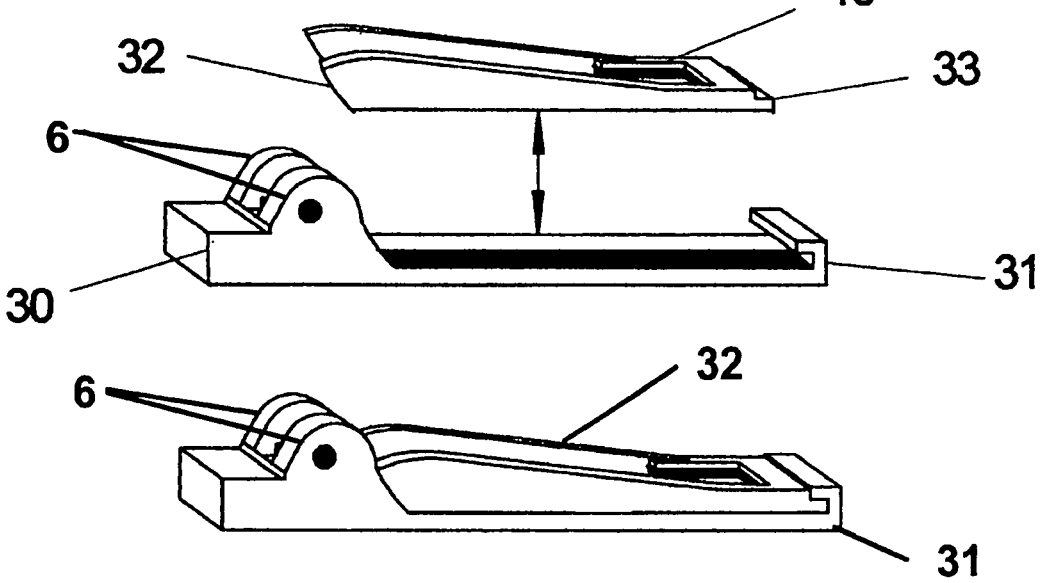
Fig. 5 (prior art)
FIG. 5 is a two piece rear sight base, posterior spring slot (prior art)
Figure 6:
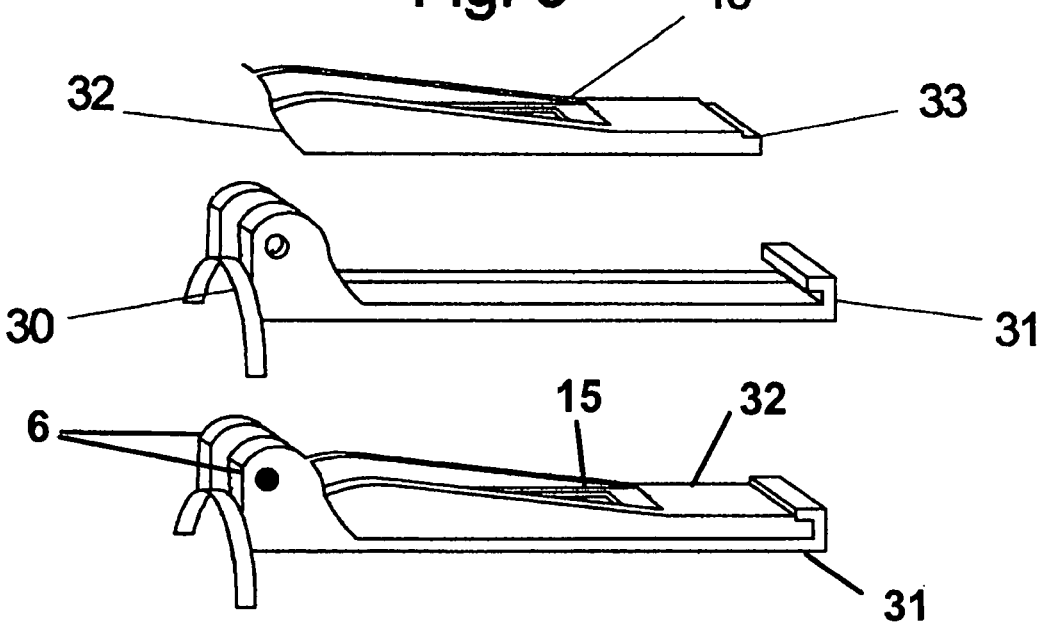
Fig. 6 (prior art)
FIG. 6 is a two piece rear sight base, forward spring slot. (prior art)
Figure 7:
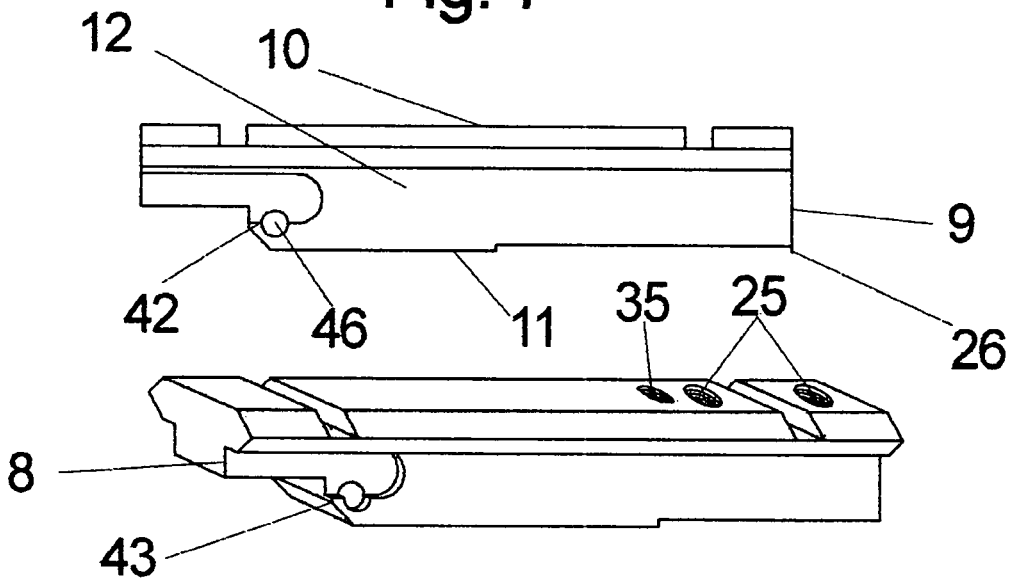
FIG. 7 is a side and prospective view of the scope mount body.
Figure 8:
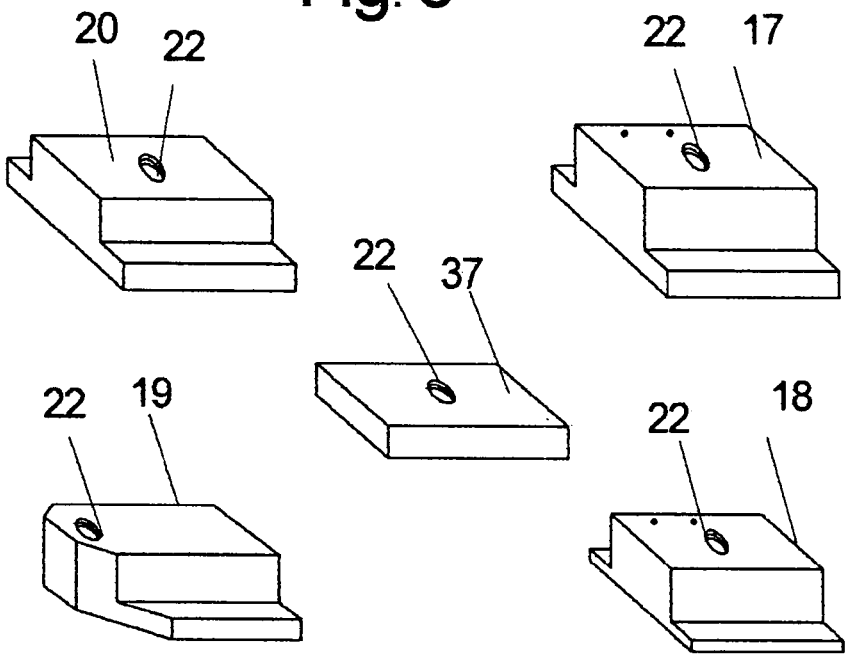
FIG. 8 is a prospective view of the four T nuts and spacer parts.
Figure 9:
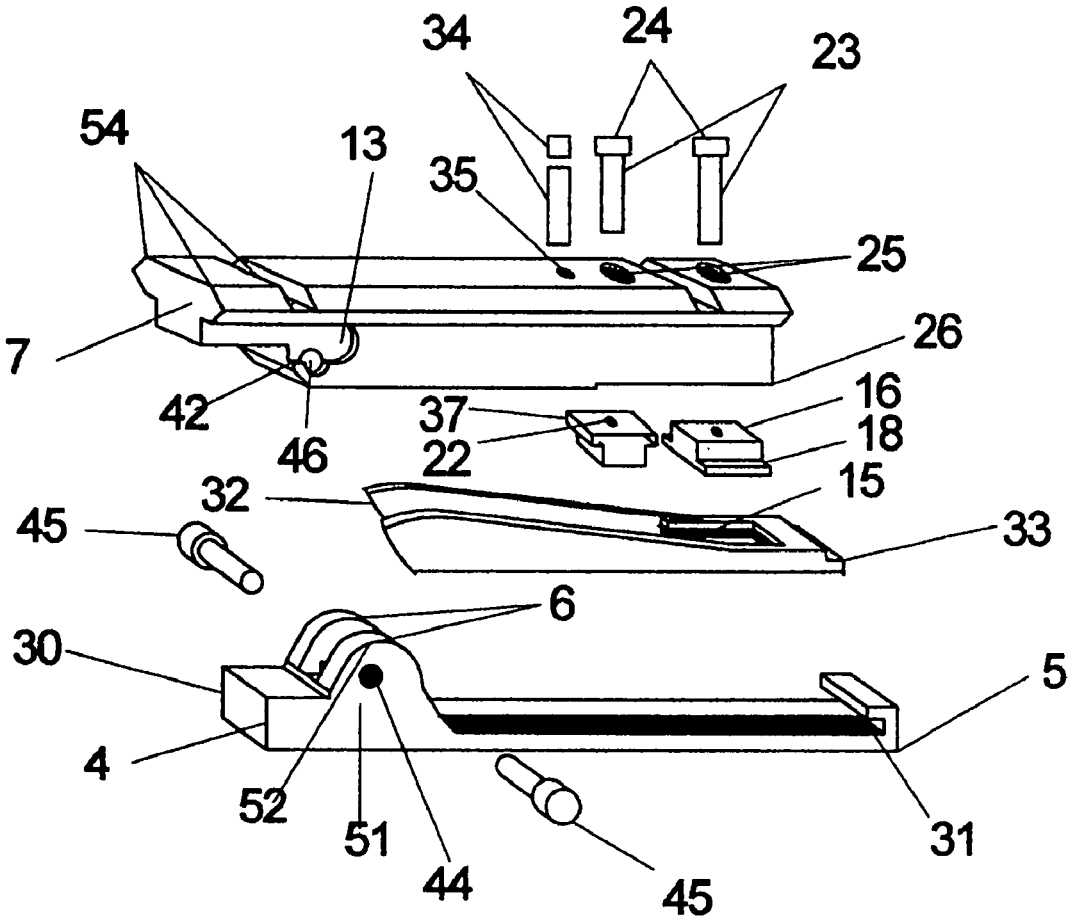
FIG. 9 is a view of the scope mount, T nut, spacer, and compression screw upon a two piece sight base with a posterior spring slot.
Figure 10:
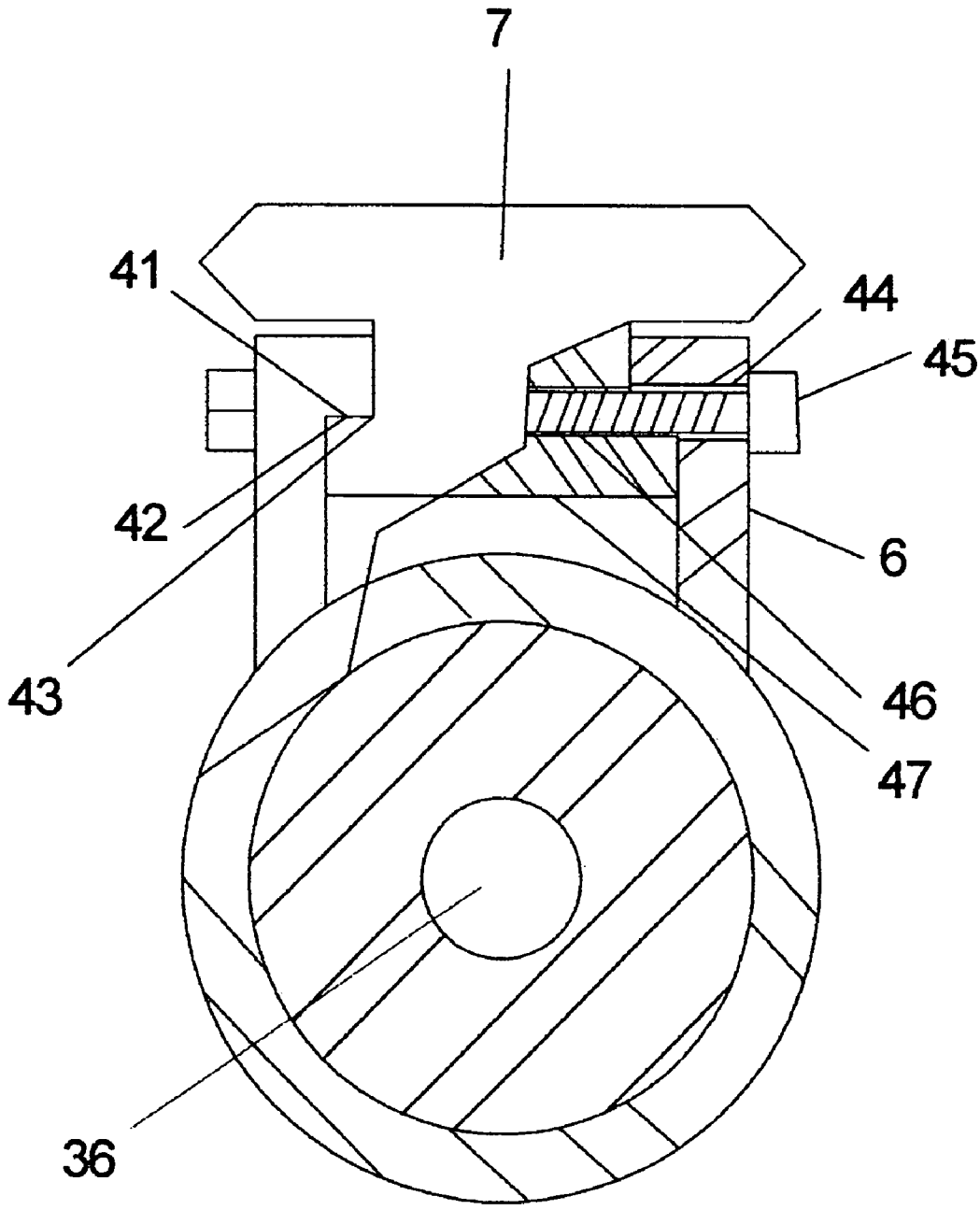
FIG. 10 is a cutaway view of the sight base anterior lock up with scope mount body, including boss bolt, boss, and boss slot.
Figure 11:
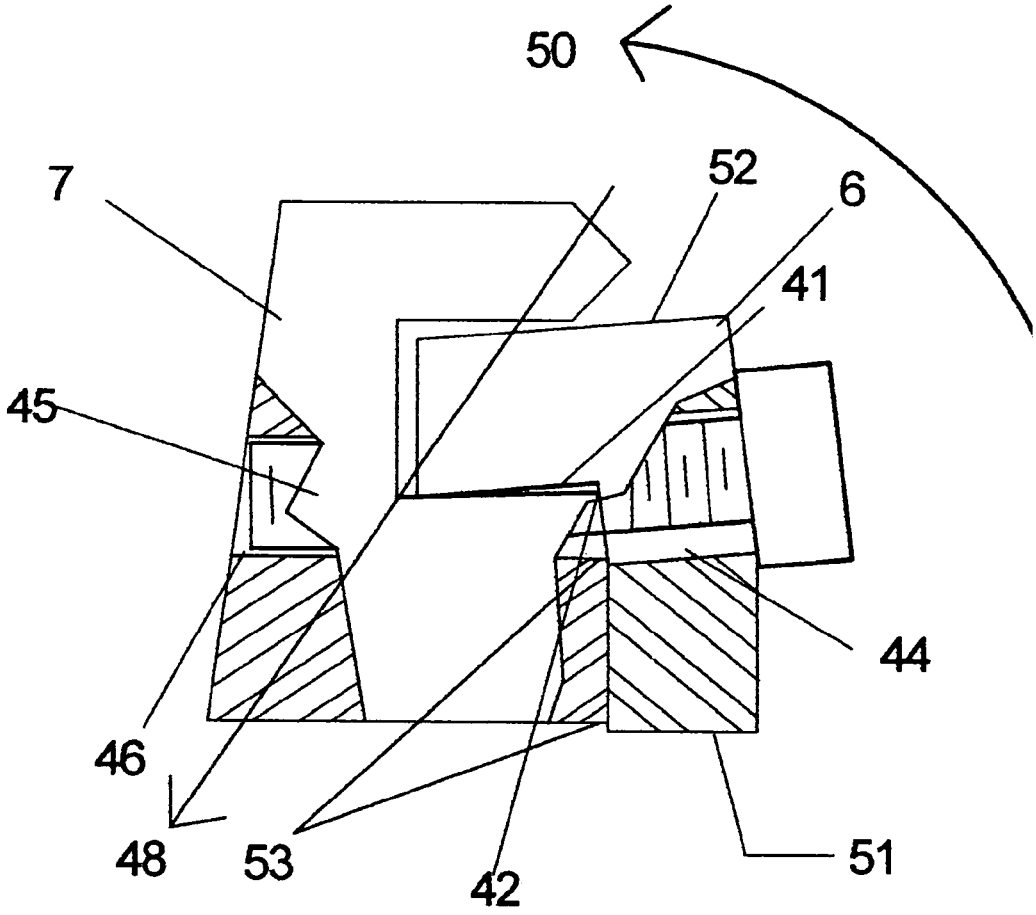
FIG. 11 is an exaggerated view of the boss bolt, boss, and boss slot interaction.
Figure 12:
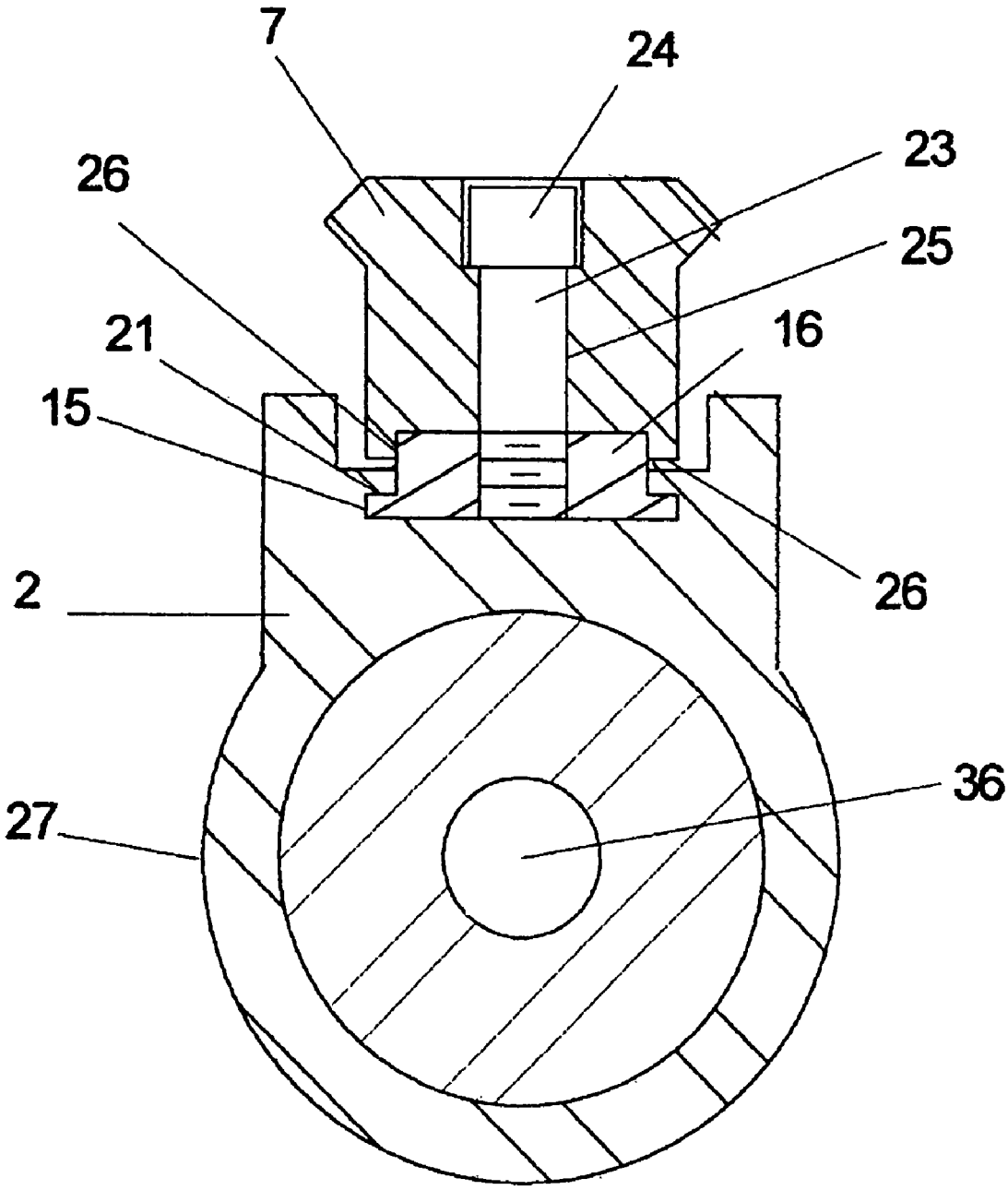
FIG. 12 is a cutaway of the posterior rear sight interaction with the T nut, and bottom body slot.
Figure 13:
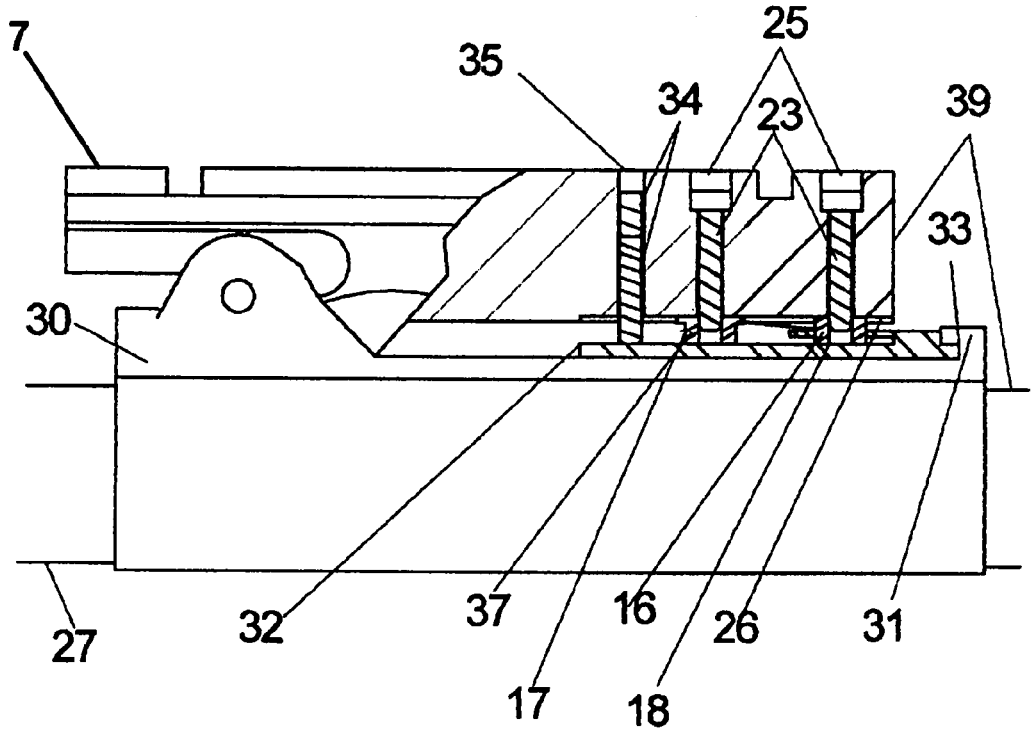
FIG. 13 is a side cutaway of the interaction of a two piece sight base (with posterior spring slots) onto the scope mount body, including the compression screw, spacer, and T nut.

Some of the sight bases are in two parts (FIGS. 5, 6). The first part (30) contains the opposing anterior vertical bosses (6). This first part is firmly attached to the barrel (27) by soldered lower clamps of the first part that wrap completely around the barrel. The second part (32), which contains the pair of opposing spring slots (15), is releasably mated to the first part. The second part is held firmly to the posterior of the first part by an L shaped bracket at the posterior of first part (31). The front of the second part is held in position by a vertical compression screw (34). This compression screw is fixed in a threaded screw hole (35) of the top (10) of the scope mount body (7). The reverse pressure screw applies firm downward pressure to the front of the second part (32) onto the first part (30) of the sight base. The application of this screw does not take place until the scope mount body (7) lockups onto the anterior and posterior of the sight base is complete. Once the screw (34) has been firmly compressed against the sight base (2), a second shorter compression screw (34) then locks the longer compression screw in place in the vertical top body screw hole (35). It is necessary that the installation of the compression screw (34) be last because the broad contact area of the spacer (if needed), and the bottom body slot (26) contact with the T nut (16) might not occur. If this situation were to occur then only the tip of the compression screw (34), onto the sight base, would be sustaining the back lock up forces, and rifle accuracy failure would probably occur, after sustaining the recoil forces of a few shots.

Having discussed the various parts of this scope mount invention, I return to discuss what I consider the most unique feature of the invention, that is the boss (6) and boss slot (13) lockup at the anterior of the sight base. The longitudinal to the rifle bore downward force (48) that is applied to the scope mount body enables the relatively thin wings (21) of the T nut (16) lockup at the posterior of the sight base to be successful in application.

I believe this down force is resulted by an inward (50) rotational compression of the boss lower edge (41) and upper area (52). This inward rotation is placed against the lower boss slot edge (42) and thickness (53) of the body.

The boss bolt is passed through the boss through hole (44) and into the boss slot lateral threaded hole (46), bisecting the boss slot lower edge (42) and thickness (53). This slot and thickness is held in place by the boss screw at the boss lower edge (41) and lower area (51). The boss lower edge and upper thickness is in contact with the boss slot and lower edge at the upper half of the boss bolt, but not actually threaded to the boss bolt due to the boss through hole (44) clearance.

As maximum contact approaches the boss slot area and the boss slot due to boss screw rotation, maximum contact will first be made by the boss slot lower thickness (53) and the boss lower thickness (51). Further screw rotation (45) now causes inward rotation (50) of the upper boss thickness (52) and particularly the lower boss edge (41) to press down on the lower boss slot edge (42). The outer threads and screw head of the boss bolt also begin an inward rotation. This inward rotation will stop when the boss screw upper portion jams against the upper area of the boss clearance hole (44)

Thus the obvious side forces being applied by the boss screw are also transferred through the boss lower edge, as an inward down force (48) against the boss slot body (13) to which the boss screw (45) is threaded and supporting. Combine this behavior with an exact mirror lock up at the other inward facing boss and the projected inward and down force towards the rifle bore is substantial.

Having discussed the components and their unique features, a discussion of actual varied scope mount installations is appropriate.

One of the more common scope mount installations to the Mauser 98 rear sight is of a two part sight base variety (FIG. 14). Begin by removing the tangent sight blade (55) and spring from the spring slot (15) of the sight base. Insert the boss screws (45) into the anterior opposing boss through holes (44), and make sure they do not touch each other as this would prevent boss compression (48) from occurring. Once satisfied, remove the screws from the boss through holes. A spacer is not needed for this installation as the scope mount lays up with a relatively good parallel (39) to the bore on its own account.

The T nut (16) used is the low height version (20). The T nut slot (15) in the sight base is located so that the forward top counter bore through hole (25) of the scope mount top body (10}, should be in good alignment. Install the T nut (20) into the T nut slot of the sight base. Fit to make sure that the T nut wings (21) slide easily in the said T nut slot.

Slide the front of the scope mount body longitudinally downward into the anterior (47) of the sight base. Make sure the boss slots (13) are situated properly under the bosses (6), and that the boss slot lateral threaded hole (46) is in alignment with the boss through hole (44)

Position the said body longitudinally so that front top counter bored through hole (25) is positioned over the threaded T nut. Insert an appropriate screw head tension screw (23), (24) into the through hole and tension. Test wiggle to make sure that the tensioned screw is actually drawing the T nut wings (21) up against the lower surface of the T nut slot (15). If some play is noted then disassemble, and stone the top of the T nut and retest fit. If all is well then release the tension on the T nut and slide the body longitudinally forward till the boss slot lateral threaded hole (46) is in alignment with the boss bolt holes (44).

Insert the boss bolt (45) screws into each boss through hole (44). Lightly tension each boss bolt against the boss (6). Continue tensioning each boss bolt equally until firmly fixed.

Return to the top body screw head tension screw (23), (24) that is lightly fixed into the T nut (20) and continue compression till the screw is firmly fixed.

Insert a headless compression screw (34) into the top body threaded hole (35). Continue the screw until firmly fixed against the front of the second part (32) of the sight base. Follow with the short headless tension screw (34) into the said top hole and firmly fix that screw against the first headless screw.

Most of the other scope mount installations on different Mauser 98 long tangent rear sight installations follow the same procedures, except for the addition of an inverted T nut or spacer (37) being installed in the bottom body capture slot (26). A screw head tension screw (23), (24) is passed through the unused top body counter bore through hole (25), which then fixes to the spacer. This operation occurs prior to sliding the body longitudinally downward into the anterior of the sight base as stated above.

If the sight base is a solid one piece version, then the head less compression screws (34) will not be utilized as they are not needed for the solid one piece rear sight base installation.

Figure 15:
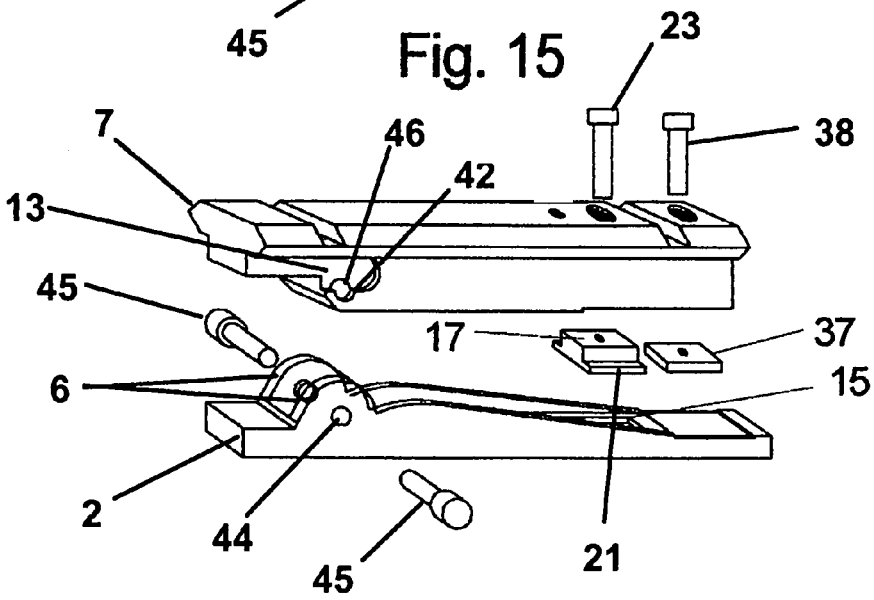
FIG. 15 is a perspective view of a one piece sight base (with forward spring slots) onto the scope mount body, including T nut and spacer.
Figure 16:
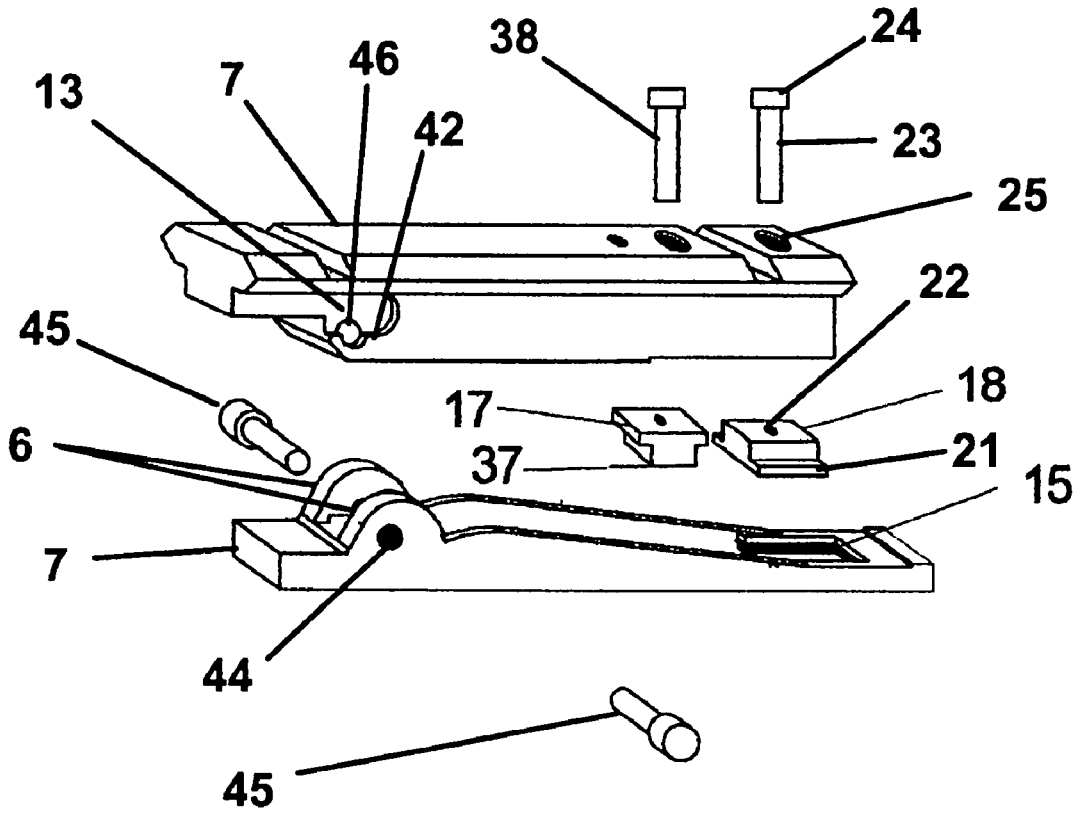
FIG. 16 is a perspective view of a one piece sight base (with posterior spring slots) onto the scope mount body, including spacer and T nut.

This concludes the installation procedure of the selected variant of the scope mount to the Mauser 98 long tangent sight base. Figures of other successful installation procedures are listed at the end of the drawings (FIGS. 5, 15, 16).

VI. LIST OF REFERENCE NUMBERS

This list of reference numbers on the drawings will be used in the description as needed to further assist in understanding my concepts for the scope mount base invention.

1—a telescopic sight
2—a sight base
3—a Mauser 98' rifle fore end
4—an anterior sight base portion
5—a posterior sight base portion
6—a pair of inwardly-projecting opposing bosses
7—a body
8—front body portion
9—back body portion
10—top body portion
11—bottom body portion
12—side body portion
13—a pair of boss slots
14—a U shaped spring slot
15—a pair of opposing spring slots
16—a T nut
17—a thick wing high T nut
18—a thin wing high T nut
19—an offset threaded hole T nut
20—a low height T nut
21—two wings
22—a threaded T nut hole
23—a tension screw
24—a screw head
25—a tension screw clearance through hole
26—bottom body capture slot
27—a barrel
28—a direction lateral to the rifle bore
29—a two part sight base
30—a first part (of the two part sight base, the part including the opposing inward bosses)
31—a posterior lateral slot of the first part
32—a second part (of the two part sight base, the part includes the spring slots)
33—the posterior end of the second part
34—a compression screw
35—a threaded compression screw hole
36—a bore
37—a spacer
38—a spacer bolt
39—an angle of said body to said bore of the rifle
40—a force in a direction toward said bore of the rifle
41—a boss lower side
42—a boss slot lower side
43—a width (of the boss slot lower side)
44—a boss through bolt hole
45—a boss bolt
46—a boss slot lateral threaded through hole
47—a capture ridge

48—a force (exerted by the bosses on the body)
49—a plane (defined by the boss bolt hole longitudinal axis and the direction of force)
50—direction of inward rotation of boss onto the boss slot
51—thinner lower area of the upward projection (boss)
52—thicker upper inward area of the upward projection (boss)
53—thickness of the body (Scope mount) beneath the boss slot
54—top body configuration to receive telescopic sight
55—Long tangent sight blade

I claim:

1. An apparatus for connecting a telescopic sight to a sight base of a rifle, the sight base having an anterior sight base portion and a posterior sight base portion, the anterior sight base portion defining a pair of inwardly-projecting opposing bosses, the apparatus comprising:

a. a body having anterior and posterior body portions, said body being configured to receive and to secure the telescopic sight, said anterior body portion defining a pair of boss slots on opposing sides of said anterior body portion, each said boss slot being configured to receive and to slidably engage a one of the inwardly-projecting bosses of the sight base, the posterior portion of the sight base defining a pair of opposing spring slots;

b. a T-nut, said T-nut having two wings, said two wings being configured to slidably engage said pair of opposing spring slots, said T-nut defining a threaded T-nut hole;

c. a tension screw having a screw head, said tension screw being configured for threaded engagement with said T-nut hole, said body defining a tension screw clearance hole, said tension screw clearance hole being configured to receive said tension screw and to retain said screw head, whereby said T-nut, said clearance hole and said tension screw are configured to apply a tension to the body drawing said body toward said sight base when said body and said sight base are in engagement, said two T-nut wings are in engagement with said pair of opposing spring slots and said tension screw is in engagement with said body and said T-nut.

2. The apparatus of claim 1 wherein said body defines a T-nut slot on a lower side of said body and wherein said rifle has a barrel defining a bore, said bore having a bore longitudinal axis, said T-nut slot being configured to engage said T-nut, said engagement between said T-nut slot and said T-nut being sufficiently close that said body is substantially prevented from moving in a direction lateral to said bore longitudinal axis when said two wings of said T-nut are in engagement with said spring slot and said T-nut slot defined by said body is in engagement with said T-nut.

3. The apparatus of claim 1 wherein the site base is a two-part site base having a first part and having a second part releasably mated to the first part, the first part defining the pair of bosses, the second part defining said pair of spring slots, the apparatus further comprising:

a. a compression screw;

b. a threaded compression screw hole defined by said body, said compression screw being configured for threaded engagement with said compression screw hole, said compression screw hole being located and said compression screw being configured so that said compression screw may bear upon said second part of said two-part sight base when said pair of boss slots defined by said body are in engagement with the pair of bosses defined by said first part of the sight base and said compression screw is in engagement with said compression screw hole, said bearing of said compression screw on said second part of the sight base applying a compression to said compression screw, whereby when said compression is applied by said compression screw and said tension is applied by said tension screw, said second part of said two-part sight base in a firm engagement with said first part of said two-part sight base.

4. The apparatus of claim 1, the apparatus further comprising:

a. a spacer;

b. a spacer bolt, said spacer bolt being configured to releasably secure said spacer to said body, said spacer being configured to engage the posterior sight base portion and to support said body when said spacer is secured to said body and said body is in engagement with said sight base, said spacer having a thickness, said thickness being selected to determine an angle of said body to said bore of the rifle.

5. The apparatus of claim 4 wherein said T-nut is a one of a plurality of said T-nuts, said spacer being selected from among said plurality of said T-nuts.

6. The apparatus of claim 5 wherein each of said plurality of said T-nuts has a one of a plurality of predetermined thicknesses, said spacer being selected based upon said predetermined thickness of said selected T-nut.

7. An apparatus for connecting a telescopic sight to a sight base of a rifle, the sight base having an anterior sight base portion and a posterior sight base portion, the anterior sight base portion defining a pair of inwardly-projecting opposing bosses, the apparatus comprising:

a body having anterior and posterior body portions, said body being configured to receive and to secure the telescopic sight, said anterior body portion defining a pair of boss slots on opposing sides of said anterior body portion, each said boss slot being configured to receive and to slidably engage a one of the inwardly-projecting bosses of the sight base, wherein the rifle has a bore and the anterior portion of the sight base has an opposing pair of upward projections, a one of the pair of bosses being defined by each one of said upward projections, said upward projections having a lower end, said lower end of each of said pair of upward projections being attached to the sight base, said body being configured to be bolted to each of said pair of upward projections, said body being configured so that each of said pair of bosses applies a force to said body generally in a direction toward said bore of the rifle when said body is bolted to said pair of upward projections.

8. The apparatus of claim 7 wherein each said upward projection elastically deforms by rotating about said lower end of said upward projection when said pair of upward projections are bolted to said body, the pair of inwardly-projecting opposing bosses each has a boss lower side and said pair of boss slots each has a boss slot lower side having a width, said configuration of said body to be applied said force in said direction of said bore of the rifle comprising each said boss slot width being sufficiently great and said engagement between said boss slot lower side and said boss lower side being sufficiently close that said boss lower side bears on said boss slot lower side in response to said elastic deformation of said upward projection when said upward projection is bolted to said body.

9. The apparatus of claim 8 wherein each said upward projection defines a boss through bolt hole, said boss bolt through bolt hole being configured to receive a boss bolt for connecting said upward projection to said body, said boss bolt through hole defining a boss bolt hole longitudinal axis, said boss through bolt hole longitudinal axis substantially bisecting said boss lower side, said configuration of said body to be bolted to each of said pair of upward projections comprising said body being configured for threaded engagement with said boss bolt when said boss bolt is received by said boss through bolt hole, whereby said threaded engagement between said boss bolt and said body resists said force in said direction of said bore of said rifle, whereby said rotation of said upward projection when said pair of upward projections are bolted to said body loads said boss bolt in flexion, and whereby a combination of said force in said direction of said bore, said resistance to said force by said threaded engagement of said boss bolt and said body, and said flexion loading of said boss bolt together provide a substantially rigid connection between said body and said upward projection.

10. The apparatus of claim 9 wherein the rifle is a Mauser 98 rifle.

11. An apparatus for connecting a telescopic sight to a sight base of a rifle, the sight base having an anterior sight base portion and a posterior sight base portion, the anterior sight base portion defining a pair of inwardly-projecting opposing bosses, the apparatus comprising:

a body having anterior and posterior body portions, said body being configured to receive and to secure the telescopic sight, said anterior body portion defining a pair of boss slots on opposing sides of said anterior body portion, each said boss slot being configured to receive and to slidably engage a one of the inwardly-projecting bosses of the sight base, wherein the rifle is a Mauser 98 rifle, the pair of inwardly projecting bosses defining a pair of boss lower surfaces, each of the pair of boss lower surfaces bisecting a boss through bolt hole, each boss through bolt hole defining a boss through bolt hole axis, each bolt hole axis generally being coincident with a plane defined by the boss lower surface, each said boss slot defining a boss slot lower surface, each said boss slot lower surface being configured to mate with a one of the pair of boss lower surfaces when said boss slots are engaged with said bosses, said body being configured to be bolted to each of the pair of bosses by a bolt passing through the boss through hole and into threaded engagement with said body, said mating of each said boss slot lower surface and each boss lower surface being sufficiently close that a deformation in rotation of the boss in response to said bolting of said body to each of said pair of bosses causes a resulting tilting of the boss lower surface to press against said boss slot lower surface, whereby said tilting of the boss lower surface clamps said body between said boss slot lower surface and said bolt.

* * * * *